US009156260B2

(12) United States Patent
Domae et al.

(10) Patent No.: US 9,156,260 B2
(45) Date of Patent: Oct. 13, 2015

(54) LIQUID JET HEAD AND LIQUID JET APPARATUS

(71) Applicant: SII PRINTEK INC., Chiba-shi, Chiba (JP)

(72) Inventors: Yoshinori Domae, Chiba (JP); Yuki Yamamura, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 14/338,826

(22) Filed: Jul. 23, 2014

(65) Prior Publication Data

US 2015/0035908 A1 Feb. 5, 2015

(30) Foreign Application Priority Data

Jul. 30, 2013 (JP) ..... 2013-158066

(51) Int. Cl.
*B41J 2/045* (2006.01)
*B41J 2/14* (2006.01)

(52) U.S. Cl.
CPC ..... *B41J 2/14209* (2013.01); *B41J 2/14201* (2013.01); *B41J 2002/14411* (2013.01); *B41J 2202/11* (2013.01); *B41J 2202/18* (2013.01)

(58) Field of Classification Search
CPC ..... B41J 2/14201; B41J 2/14209; B41J 2/14274; B41J 2002/14266; B41J 2002/14306
See application file for complete search history.

(56) References Cited

U.S. PATENT DOCUMENTS 5,646,661 A * 7/1997 Asai et al. ..... 347/69
5,680,163 A * 10/1997 Sugahara ..... 347/71

FOREIGN PATENT DOCUMENTS

| | | |
|---|---|---|
| EP | 2130678 | 12/2009 |
| EP | 2540503 | 1/2013 |
| JP | 07178903 | 7/1995 |
| JP | 9207331 | 8/1997 |
| JP | 2002103614 | 4/2002 |
| JP | 200394654 | 4/2003 |

OTHER PUBLICATIONS

IPO Search Report mailed Jan. 15, 2015 issued in Appln. No. GB1413342.5.

* cited by examiner

*Primary Examiner* — Geoffrey Mruk
(74) *Attorney, Agent, or Firm* — Adams & Wilks

(57) ABSTRACT

A liquid jet head has a piezoelectric body substrate which includes a groove row in which ejection grooves penetrating the piezoelectric body substrate from an upper surface through a lower surface and non-ejection grooves open on the upper surface are alternately arranged in a reference direction, common drive electrodes formed on both side surfaces of each of the ejection grooves, and individual drive electrodes formed on both side surfaces of each of the non-ejection grooves. A cover plate is bonded to the upper surface of the piezoelectric body substrate and includes a liquid chamber communicating with the ejection grooves, first through electrodes which penetrate the cover plate in a thickness direction and are electrically connected to the individual drive electrodes, and individual terminals placed on a front surface of the cover plate opposite to the piezoelectric body substrate and electrically connected to the first through electrodes.

13 Claims, 8 Drawing Sheets

LIQUID JET HEAD AND LIQUID JET APPARATUS

BACKGROUND

1. Technical Field

The present invention relates to a liquid jet head which jets liquid droplets onto a recording medium to perform recoding and a liquid jet apparatus.

2. Related Art

Recently, there has been used a liquid jet head of an ink jet system that ejects ink droplets onto a recording paper or the like to record characters or figures thereon, or ejects a liquid material onto the surface of an element substrate to form a functional thin film thereon. In the ink jet system, liquid such as ink and or a liquid material is guided from a liquid tank into a channel through a supply tube, and pressure is applied to the liquid filled in the channel to thereby eject the liquid as liquid droplets from a nozzle that communicates with the channel. When ejecting liquid droplets, characters or figures are recorded, or a functional thin film having a predetermined shape is formed by moving the liquid jet head or a recording medium.

In JP 7-178903 A, there is described an edge shoot liquid jet head 100 which has a plurality of grooves formed on a piezoelectric body substrate as channels for ejecting liquid and ejects liquid droplets from ends of the grooves. FIG. 8A is a schematic cross-sectional view of the liquid jet head 100 in a direction perpendicular to the grooves as channels. FIG. 83 is a schematic cross-sectional view of an ink chamber 103 in the groove direction. The liquid jet head 100 is provided with a piezoelectric ceramic plate 102, a cover plate 110 which is bonded to an upper surface of the piezoelectric ceramic plate 102, and a nozzle plate 114 which is bonded to a side surface of the piezoelectric ceramic plate 102. In the piezoelectric ceramic plate 102, grooves 119 which constitute the ink chambers 103 and grooves 104 in which liquid is not filled are alternately arranged with partition walls 106 interposed therebetween. The cover plate 110 is adhered to the upper surface of the piezoelectric ceramic plate 102 through an epoxy resin 120. A manifold 121 is formed on the cover plate 110. The manifold 121 communicates with the ends of the grooves 119 so that ink can be supplied. A PZT ceramic plate is used as the piezoelectric ceramic plate 102. The piezoelectric ceramic plate 102 is polarized in a polarization direction 105.

The grooves 104 are formed by performing cutting so as to penetrate the cover plate 110 up to the piezoelectric ceramic plate 102. In each of the partition walls 106 which partition the grooves 119 and the grooves 104, a metal electrode 108 is formed on one side surface facing an ink chamber 103, and an electrode 117 is formed on the other side surface facing a groove 104. The metal electrodes 108 are formed above the center in the depth direction of the grooves 119, and extracted as metal electrodes 109 to shallow grooves 107 on the side of an end surface 115 of the piezoelectric ceramic plate 102, the end surface 115 being located opposite to the nozzle plate 114. The electrode 117 is formed on inner side surfaces and a bottom surface of each of the grooves 104 and a flat portion 116 of the cover plate 110. The electrodes 117 is set to a common potential, and a drive signal is applied to the metal electrodes 109 to cause pressure waves in liquid filled in the ink chambers 103, thereby ejecting liquid droplets from nozzles 112.

In the liquid jet head 100 described in JP 7-178903 A, it is necessary to allow a large number of metal electrodes 109 to be exposed on an upper surface of the piezoelectric ceramic plate 102 at the side of the end surface 115 located opposite to the nozzle plate 114. Therefore, the length in the groove direction of the piezoelectric ceramic plate 102 is required to be longer than the width of the cover plate 110. Further, the grooves 104 are formed by performing cutting from the cover plate 110 using a diamond blade. When forming the grooves 104, it is necessary to prevent the diamond blade from reaching the manifold 121, and therefore form the grooves 104 so as to be separated from the manifold 121. Therefore, the length in the groove direction of the piezoelectric ceramic plate 102 is made longer.

Further, the electrode 117 formed on the grooves 104 is formed across an adhesive layer which is formed of the epoxy resin 120 between the piezoelectric ceramic plate 102 and the cover plate 110. When the material of the piezoelectric ceramic plate 102 and the material of the cover plate 110 are different from each other, distortion is likely to occur on the boundary due to a thermal expansion difference. Further, since the partition walls 106 are movable walls, a mechanical stress always acts. Therefore, the electrode 117 passing across the epoxy resin 120 may be broken, and it is difficult to configure the liquid jet head 100 with high reliability.

SUMMARY OF THE INVENTION

A liquid jet head of the present invention is provided with: a piezoelectric body substrate which includes at least one groove row in which ejection grooves penetrating the piezoelectric body substrate from an upper surface through a lower surface and non-ejection grooves open on the upper surface are alternately arranged in a reference direction, common drive electrodes formed on both side surfaces of each of the ejection grooves, and individual drive electrodes formed on both side surfaces of each of the non-ejection grooves; and a cover plate which is bonded to the upper surface of the piezoelectric body substrate and includes a liquid chamber communicating with the ejection grooves, first through electrodes penetrating the cover plate in a thickness direction, the first through electrodes being electrically connected to the individual drive electrodes, and individual terminals placed on a front surface opposite to the piezoelectric body substrate, the individual terminals being electrically connected to the first through electrodes.

Further, the piezoelectric body substrate includes a common wiring unit electrically connected to the common drive electrodes and individual wiring units electrically connected to the individual drive electrodes, the common wiring unit and the individual wiring units being placed on the upper surface of the piezoelectric body substrate, and the individual drive electrodes and the first through electrodes are electrically connected to each other through the individual wiring units.

Further, the individual wiring units are placed on opposite ends in the longitudinal direction of opening portions in which the non-ejection grooves are open so as to be electrically separated from each other, and an individual wiring unit located on one end is electrically connected to an individual drive electrode formed on one side surface of a non-ejection groove and an individual wiring unit located on the other end is electrically connected to an individual drive electrode formed on the other side surface of the non-ejection groove.

Further, the cover plate includes first intermediate electrodes which are electrically connected to the first through electrodes and placed on a back surface facing the piezoelectric body substrate, and the individual wiring units and the first through electrodes are electrically connected to each other through the first intermediate electrodes.

Further, the cover plate includes a second through electrode which penetrates the cover plate in the thickness direction and is electrically connected to the common wiring unit and a common terminal which is electrically connected to the second through electrode and placed on the front surface opposite to the piezoelectric body substrate.

Further, the cover plate includes a second intermediate electrode which is electrically connected to the second through electrode and placed on the back surface facing the piezoelectric body substrate, and the common wiring unit and the second through electrode are electrically connected to each other through the second intermediate electrode.

Further, a common drive electrode formed on one of the ejection grooves and another common drive electrode formed on another one of the ejection grooves are electrically connected to each other through the common terminal.

Further, a common drive electrode formed on one of the ejection grooves and another common drive electrode formed on another one of the ejection grooves are electrically connected to each other through the common wiring unit.

Further, two individual drive electrodes formed on side surfaces of two adjacent non-ejection grooves between which an ejection groove is interposed, the side surfaces facing the ejection groove, are electrically connected to each other through the corresponding one of the individual terminals.

Further, each of the individual terminals is placed on the cover plate across the corresponding one of the ejection grooves in a plan view viewed from the normal direction of the piezoelectric body substrate.

Further, the liquid jet head further includes a flexible circuit board including wiring, wherein the flexible circuit board is electrically connected to the front surface of the cover plate by the wiring being electrically connected to the individual terminals.

Further, the at least one groove row includes a plurality of groove rows arranged in parallel to each other in the reference direction.

Further, in adjacent ones of the groove rows, ends on a second side of ejection grooves included in a groove row located on a first side and ends on the first side of non-ejection grooves included in a groove row located on the second side are separated from each other, and overlap each other in a thickness direction of the piezoelectric body substrate.

A liquid jet apparatus according to an embodiment of the present invention includes the liquid jet head described above; a movement mechanism configured to relatively move the liquid jet head and a recording medium; a liquid supply tube configured to supply liquid to the liquid jet head; and a liquid tank configured to supply the liquid to the liquid supply tube.

The liquid jet head according to the present invention is provided with: a piezoelectric body substrate which includes at least one groove row in which ejection grooves penetrating the piezoelectric body substrate from an upper surface through a lower surface and non-ejection grooves open on the upper surface are alternately arranged in a reference direction, common drive electrodes formed on both side surfaces of each of the ejection grooves, and individual drive electrodes formed on both side surfaces of each of the non-ejection grooves; and a cover plate which is bonded to the upper surface of the piezoelectric body substrate and includes a liquid chamber communicating with the ejection grooves, first through electrodes penetrating the cover plate in a thickness direction, the first through electrodes being electrically connected to the individual drive electrodes, and individual terminals placed on a front surface opposite to the piezoelectric body substrate, the individual terminals being electrically connected to the first through electrodes. Accordingly, it is possible to shorten the length in the groove direction of the piezoelectric body substrate, and thereby make the liquid jet head compact.

DETAILED DESCRIPTION OF THE INVENTION

First Embodiment

Figure 1:
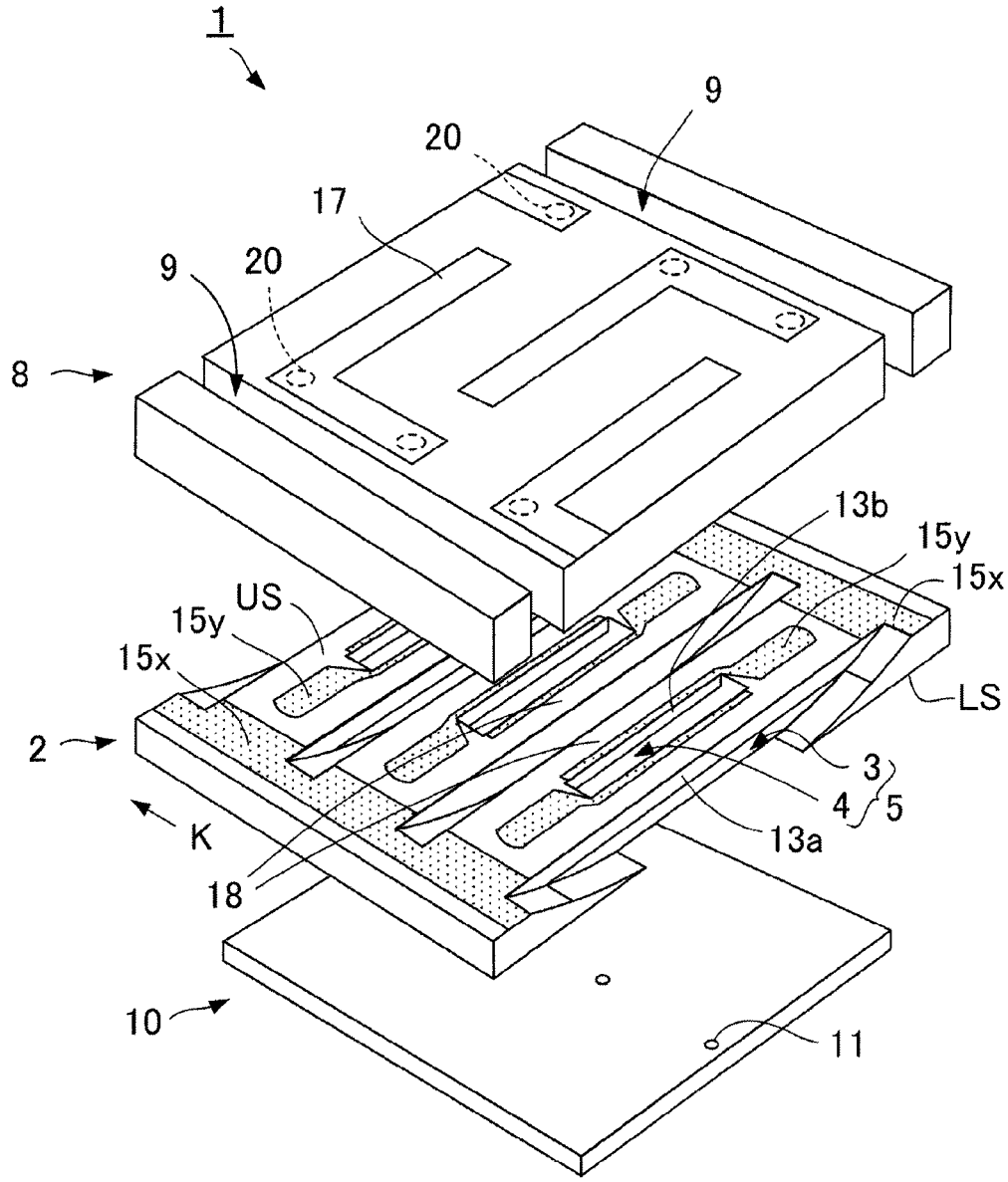
FIG. 1 is a schematic perspective view of a liquid jet head according to a first embodiment of the present invention.
Figure 2A:
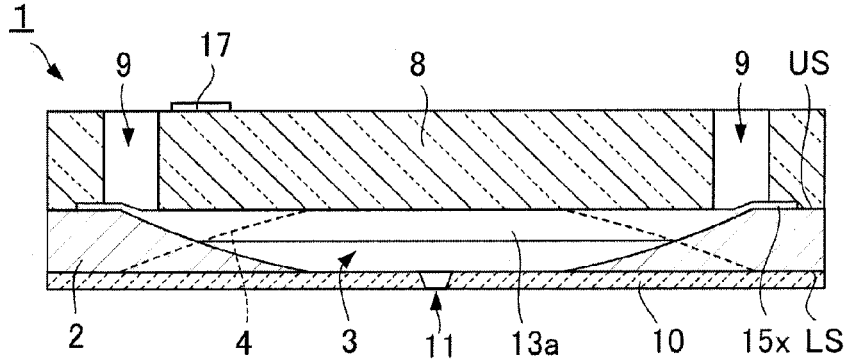
FIGS. 2A to 2C are explanatory drawings of the liquid jet head according to the first embodiment of the present invention.
Figure 2B:
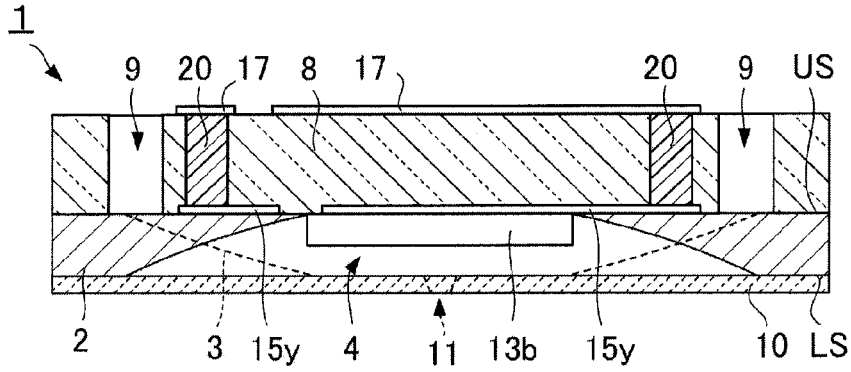
Figure 2C:
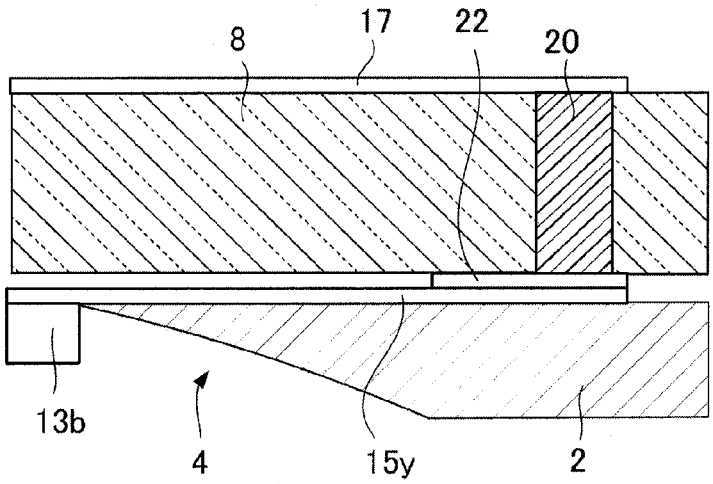
Figure 3A:
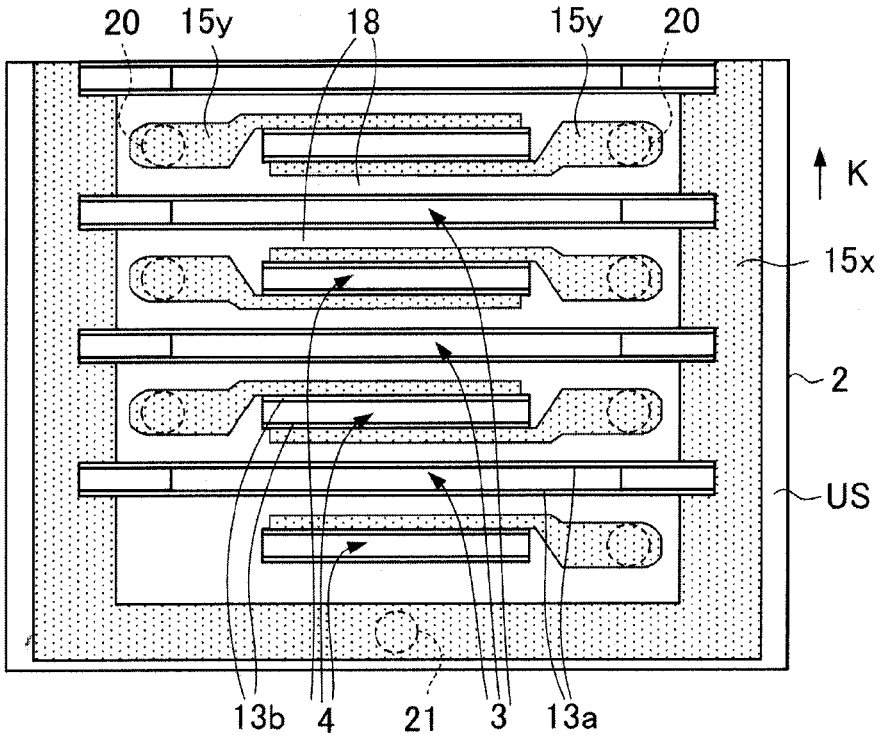
FIGS. 3A and 3B are explanatory drawings of the liquid jet head according to the first embodiment of the present invention.
Figure 3B:
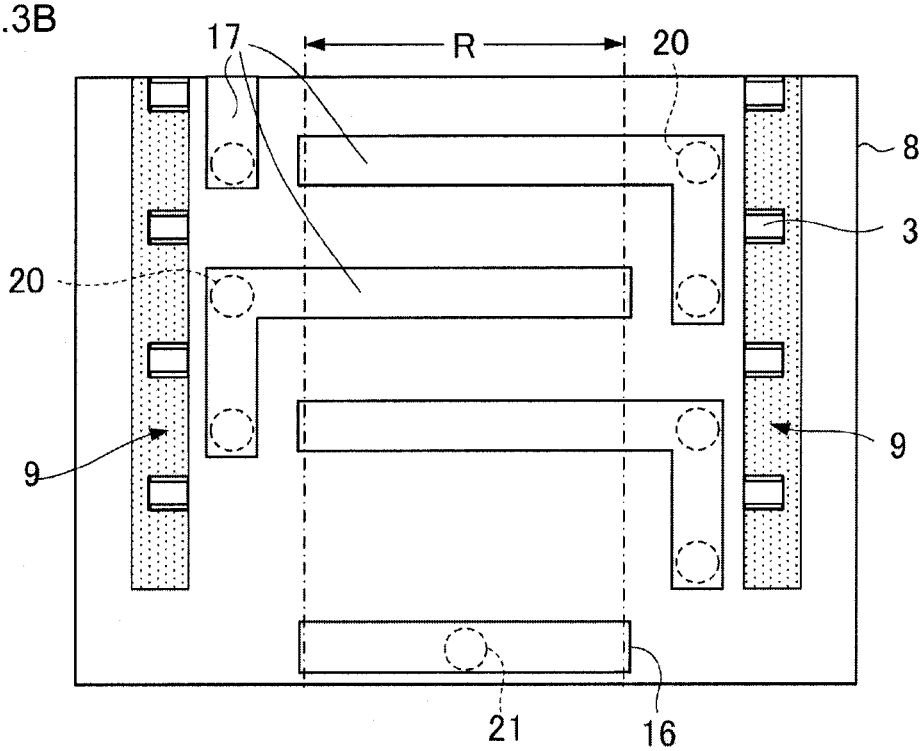

FIG. 1 is a schematic perspective view of a liquid jet head 1 according to a first embodiment of the present invention. FIGS. 2A to 2C and FIGS. 3A and 3B are explanatory drawings of the liquid jet head 1 according to the first embodiment of the present invention. FIG. 2A is a schematic cross-sectional view of an ejection groove 3 in the groove direction. FIG. 2B is a schematic cross-sectional view of a non-ejection groove 4 in the groove direction. FIG. 2C is a schematic cross-sectional view illustrating a modified example of a connection structure between an individual drive electrode 13*b* and a first through electrode 20. FIG. 3A is a schematic plan view of a piezoelectric body substrate 2 viewed from the upper side. FIG. 3B is a schematic plan view of a cover plate 8 viewed from the upper side.

As illustrated in FIG. 1, the liquid jet head 1 is provided with the piezoelectric body substrate 2, the cover plate 8 which is bonded to an upper surface US of the piezoelectric body substrate 2, and a nozzle plate 10 which is bonded to a lower surface LS of the piezoelectric body substrate 2. The piezoelectric body substrate 2 has a groove row 5 in which ejection grooves 3 which penetrate the piezoelectric body substrate 2 from the upper surface US through the lower surface LS and non-ejection grooves 4 which are open on the upper surface US and penetrate the piezoelectric body substrate 2 from the lower surface LS through the upper surface US are alternately arranged in a reference direction K. Common drive electrodes 13*a* are formed on both side surfaces of each of the ejection grooves 3 and individual drive electrodes 13*b* are formed on both side surfaces of each of the non-ejection grooves 4. The ejection grooves 3 and the non-ejection grooves 4 are partitioned by side walls 18. The cover plate 8 is provided with two liquid chambers 9 which communicate with the ejection grooves 3, first through electrodes 20 which penetrate the cover plate 8 in the thickness direction and are electrically connected to the individual drive electrodes 13*b*, and individual terminals 17 which are placed on a front surface opposite to the piezoelectric body substrate 2 and are electrically connected to the first through electrodes 20. In FIGS. 1, and 3A and 3B, for the purpose of easy understanding, a common wiring unit 15*x* and individual wiring units 15*y* are indicated by stipple.

Detailed description will be made. On the upper surface US of the piezoelectric body substrate 2, the ejection grooves 3 and the non-ejection grooves 4 are alternately open at equal intervals in the reference direction K. As illustrated in FIGS. 2A and 2B, each of the ejection grooves 3 has a shape whose opposite ends in the groove direction are inclined outward from the lower surface LS toward the upper surface US. Each of the non-ejection grooves 4 has a vertically inverted shape of the ejection groove 3, penetrates the piezoelectric body substrate 2 from the lower surface LS through the upper surface US, and has a shape whose opposite ends in the groove direction are inclined outward from the upper surface US toward the lower surface LS. Therefore, the length in the groove direction of an opening portion of each of the ejection grooves 3 is longer than the length in the groove direction of an opening portion of each of the non-ejection grooves 4, the opening portions being open on the upper surface US. Each of the ejection grooves 3 is provided with common drive electrodes 13*a* which are formed on both side surfaces thereof in a part between a position corresponding to approximately ½ of the thickness of the piezoelectric body substrate 2 and the upper surface US. Each of the non-ejection grooves 4 is provided with individual drive electrodes 13*b* which are formed on both side surfaces thereof in a part between a position corresponding to approximately ½ of the thickness of the piezoelectric body substrate and the upper surface US.

As the piezoelectric body substrate 2, a PZT ceramic substrate can be used. The piezoelectric body substrate 2 is uniformly polarized in a direction perpendicular to the surface of the substrate. In the present embodiment, the drive electrodes 13*a* and the individual drive electrodes 13*b* are formed between the position corresponding to approximately ½ of the depth of the grooves and the upper surface US. Alternatively, when a chevron type laminate piezoelectric body substrate obtained by laminating a piezoelectric body substrate which is polarized toward the upper side of the direction perpendicular to the surface of the substrate and a piezoelectric body substrate which is polarized toward the lower side of the direction perpendicular to the surface of the substrate is used as the piezoelectric body substrate 2, the common drive electrodes 13*a* and the individual drive electrodes 13*b* can be formed from the upper ends of the grooves up to a depth deeper than the polarization boundary. A material having a thermal expansion coefficient equal to that of the piezoelectric body substrate 2 can be used as the cover plate 8. For example, PZT ceramics or machinable ceramics can be used.

As illustrated in FIGS. 1 and 3A, the piezoelectric body substrate 2 is provided with the common wiring unit 15*x* and the individual wiring units 15*y* on the upper surface US. The common wiring unit 15*x* is placed near ends of the opening portions in which the ejection grooves 3 are open on the upper surface US so as to surround the groove row 5, and electrically connected to the common drive electrodes 13*a* formed on the side surfaces of the ejection grooves 3. The individual wiring units 15*y* are placed on opposite ends in the longitudinal direction of opening portions in which the non-ejection grooves 4 are open on the upper surface US so as to be electrically separated from each other. An individual wiring unit 15*y* on one end is electrically connected to an individual drive electrode 13*b* that is formed on one side surface of a non-ejection groove 4, and an individual wiring unit 15*y* on the other end is electrically connected to an individual drive electrode 13*b* that is formed on the other side surface of the non-ejection groove 4. Two individual wiring units 15*y* located on one end and the other end are electrically separated from each other.

As illustrated in FIGS. 1 and 3B, the cover plate 8 is provided with the two liquid chambers 9, first and second through electrodes 20 and 21, the individual terminals 17 which are electrically connected to the first electrodes 20, and a common terminal 16 which is electrically connected to the second through electrode 21. One of the liquid chambers 9 communicates with ends on a first side of the ejection grooves 3, and the other liquid chamber 9 communicates with ends on a second side of the ejection grooves 3. The non-ejection grooves 4 are not open in an area of the upper surface US, the area corresponding to the liquid chambers 9, and therefore do not communicate with the liquid chambers 9. The second through electrode 21 penetrates the cover plate 8 in the thickness direction thereof, and is electrically connected to the common wiring unit 15*x*. Further, the second through electrode 21 is placed on an end in the arrangement direction of the groove row 5 of the cover plate 8, and electrically connected to the common terminal 16 which is placed on the front surface of the cover plate 8, the front surface being opposite to the piezoelectric body substrate 2. The first and second through electrodes 20 and 21, the individual terminals 17, and the common terminal 16 can be formed to have a low resistance by a plating method or the like.

The piezoelectric body substrate 2 is provided with the individual wiring units 15*y* on the upper surface US thereof. The individual drive electrodes 13*b* of the non-ejection grooves 4 and the first through electrodes 20 are electrically connected to each other through the individual wiring units 15*y*. Each of the individual terminals 17 placed on the front surface of the cover plate 8 has an L shape, and is electrically connected to two first through electrodes 20 on a bottom part of the L shape. The two first through electrodes 20 are electrically connected to respective two individual wiring units 15*y* that are formed on the upper surface US with an ejection groove 3 interposed therebetween. That is, two individual drive electrodes 13*b* that are formed on side surfaces of two non-ejection grooves 4 between which an ejection groove 3 is interposed, the side surfaces facing the ejection groove 3, are electrically connected to each other through an individual terminal 17 placed on the front surface of the cover plate 8. In a plan view viewed from the normal direction of the piezoelectric body substrate 2, the bottom part of the L shape of each of the individual terminals 17 is placed on the front surface of the cover plate 8 across the corresponding ejection groove 3. The L-shaped individual terminals 17 are arranged in the reference direction K with the bottom parts of the L shapes alternately facing right and left (that is, alternately facing the first side and the second side of opening portions of the non-ejection grooves 4). The number of individual terminals 17 is equal to the number of ejection grooves 3. Further, the arrangement pitch of the individual terminals 17 is equal to the arrangement pitch of the ejection grooves 3 in the reference direction K. An upper part of the L shape of each of the individual terminals 17 functions as an electrode terminal which is electrically connected to an external circuit. A flexible circuit board is connected to a region R which is elongated in the arrangement direction of the groove row 5, and a drive signal generated in the external circuit can be supplied to the common terminal 16 and the individual terminals 17 through the flexible circuit board. Further, instead of the flexible circuit board, the common terminal 16 and the individual terminals 17 can be connected to the external circuit by a wire bonding method.

The L shape of the individual terminals 17 is not an essential requirement in the present invention. The individual terminals 17 may have a T shape, or another shape. Further, instead of the configuration in which two individual drive electrodes 13*b* that are formed on side surfaces of two non-ejection grooves 4 between which an ejection groove 3 is interposed, the side surfaces facing the ejection groove 3, are electrically connected to each other through an individual terminal 17, the two individual drive electrodes 13*b* may be electrically connected to each other through wiring of the flexible circuit board or the external circuit connected to the individual terminal 17. Further, the common wiring unit 15*x* and the common terminal 16 may be electrically connected to each other through two or more second through electrodes 21. Since large current flows in the second through electrode 21, it is preferred to provide a plurality of second through electrodes 21 to reduce the wiring resistance.

Further, when the ejection grooves 3 has a fine arrangement pitch in the reference direction K, the individual terminals 17 also has a fine arrangement pitch in the reference direction K in the region R. In this case, individual wiring units 15*y* located on the opposite ends of an opening portion of each of the ejection grooves 4 may be placed so as to be separated from each other at the center in the width direction of the region R. Accordingly, the arrangement pitch in the reference direction K of the individual terminals 17 on the opposite ends is doubled. As a result, connection with the external circuit becomes easy.

The liquid jet head 1 is driven in the following manner. Liquid is supplied to one of the liquid chambers 9 to fill the liquid in the ejection grooves 3, and discharged from the other liquid chamber 9. Further, a drive signal is applied between the individual terminals 17 and the common terminal 16 to cause the side walls 18 of the ejection grooves 3 to thickness-shear deform. Accordingly, the capacity of the ejection grooves 3 is changed, which causes pressure waves in liquid filled in the ejection grooves 3. As a result, liquid droplets are ejected from the nozzles 11. Practically, the common terminal 16 is set to GND, and a drive signal is independently applied to each of the individual terminals 17 to independently drive each of the ejection grooves 3. Liquid is filled in the ejection grooves 3, but, on the other hand, not filled in the non-ejection grooves 4. The individual wiring units 15*y*, the first through electrodes 20, and the individual terminals 17 do not have contact with liquid. Therefore, even when conductive liquid is used, a drive signal does not leak through the liquid. Further, since the individual terminals 17 and the common terminal 16 for the input of a drive signal are placed on the front surface of the cover plate 8 above the groove row 5, the width in the groove direction of the liquid jet head 1 can be made compact. Further, liquid may be supplied to the ejection grooves 3 from both of the liquid chambers 9.

FIG. 2C illustrates a modified example of the first embodiment. The cover plate 8 is provided with first intermediate electrodes 22 which are electrically connected to the first through electrodes 20 and placed on a back surface thereof facing the piezoelectric body substrate 2. The individual wiring units 15*y* and the first through electrodes 20 are electrically connected to each other through the first intermediate electrodes 22. Similarly, the cover plate 8 is provide with a second intermediate electrode (not illustrated) which is electrically connected to the second through electrode 21 and placed on the back surface thereof facing the piezoelectric body substrate 2. The common wiring unit 15*x* and the second through electrode 21 are electrically connected to each other through the second intermediate electrode. The individual wiring units 15*y* and the first intermediate electrodes 22 may be electrically connected to each other by direct contact or through an anisotropic conductive sheet. Also, the common wiring unit 15*x* and the second intermediate electrode may be electrically connected to each other by direct contact or through an anisotropic conductive sheet. By placing the first intermediate electrodes 22 and the second intermediate electrode, it is possible to reduce the contact resistance between the piezoelectric body substrate 2 and the cover plate 8. Further, since it is not necessary to place the first through electrode 20 on the individual wiring units 15*y* and the second through electrode 21 on the common wiring unit 15*x*, the design flexibility is increased.

In the first embodiment, since the ejection grooves 3 and the non-ejection grooves 4 are formed using a dicing blade which is a disk-like blade having a cutting material embedded on the periphery thereof, opposite ends of each of the grooves have inclined surfaces which are inclined outward from the lower surface LS toward the upper surface US or inclined outward from the upper surface US toward the lower surface LS. However, in the present invention, forming inclined surfaces on the ends of the grooves is not an essential requirement. The grooves may penetrate the piezoelectric body substrate 2 from the upper surface US through the lower surface LS in a straight form. Also in this case, in order to prevent the non-ejection grooves 4 from communicating with the liquid chambers 9 of the cover plate 8 which is bonded to the upper surface US, the length in the groove direction of the non-ejection grooves 4 is made shorter than the length in the groove direction of the ejection grooves 3.

Second Embodiment

Figure 4A:
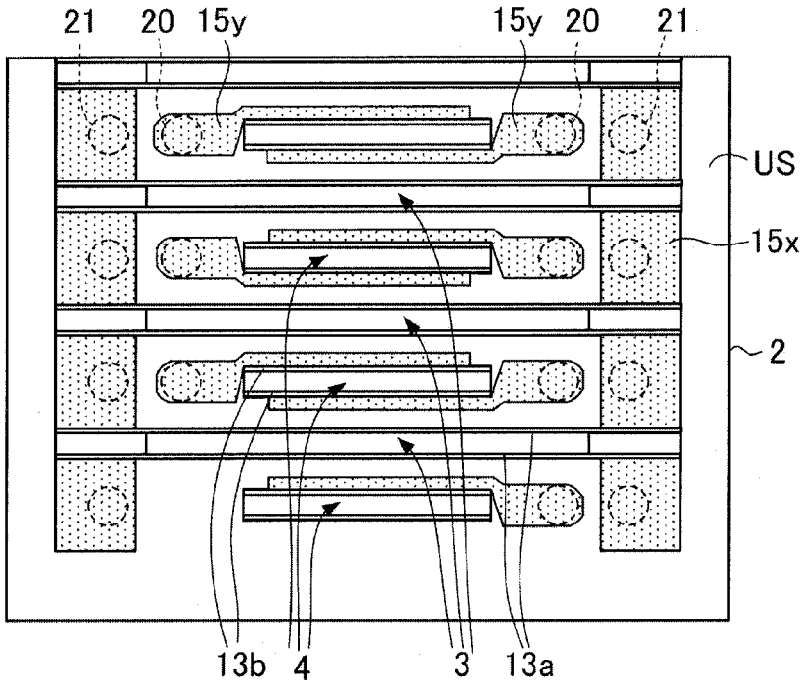
FIGS. 4A and 4B are explanatory drawings of a liquid jet head according to a second embodiment of the present invention.
Figure 4B:
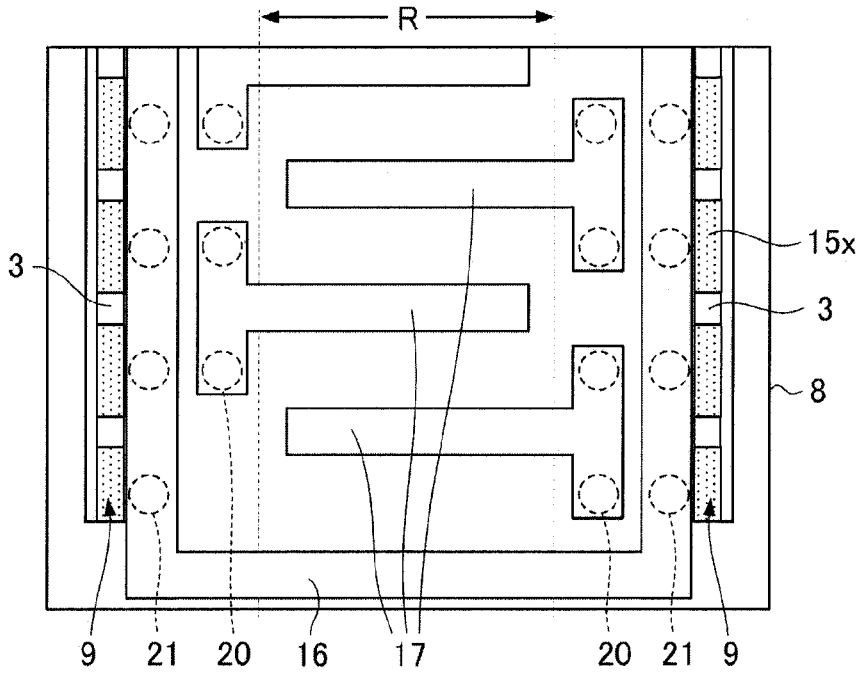

FIGS. 4A and 4B are explanatory drawings of a liquid jet head 1 according to a second embodiment of the present invention. FIG. 4A is a schematic top view of a piezoelectric body substrate 2. FIG. 4B is a schematic top view of a cover plate 8. Different points from the first embodiment is that a plurality of second through electrodes 21 are formed corresponding to ejection grooves 3, the shape of a common terminal 16, and the shape of individual terminals 17. The other configurations are the same as those of the first embodiment. Therefore, hereinbelow, the different points will be described, and description of the same configurations will be omitted. The same components or components having the same function are denoted by the same reference characters throughout the drawings.

As illustrated in FIG. 4A, common wiring units 15*x* are placed on an upper surface US of the piezoelectric body substrate 2 at positions between the ejection grooves 3 near the ends thereof. Each of the common wiring units 15*x* is electrically connected to at least common drive electrodes 13*a* that are formed on side surfaces of adjacent ejection grooves 3. Two common drive electrodes 13*a* that are formed on both side surfaces of each of the ejection grooves 3 are electrically connected to each other on the bottom of a region in which opposite ends of the ejection groove 3 are inclined outward from the lower surface toward the upper surface. Therefore, the common drive electrodes 13*a* formed on all of the ejection grooves 3 are electrically connected to each other through the common wiring units 15*x*. In other words, a common drive electrode 13*a* formed on one of the ejection grooves 3 and another common drive electrode 13*a* formed on another one of the ejection grooves 3 are electrically connected to each other through the common wiring units 15*x* placed on the upper surface US of the piezoelectric body substrate 2.

Further, the cover plate 8 has the second through electrodes 21 which correspond to the respective common wiring units 15*x* placed between the ejection grooves 3. In the present embodiment, the common wiring units 15*x* are placed near the ends of the ejection grooves 3, and the second through electrodes 21 are placed corresponding to the respective common wiring units 15*x*. Therefore, the number of second through electrodes 21 provided in the cover plate 8 is twice the number of ejection grooves 3. Further, the cover plate 8 is provided with a common terminal 16 which is formed on a front surface thereof opposite to the piezoelectric body substrate 2 and electrically connected to the second through electrodes 21. Therefore, two common drive electrodes 13*a* formed on both side surfaces of each of the ejection grooves 3 are electrically connected to each other in the common terminal 16 through two second through electrodes 21. In other words, a common drive electrode 13*a* formed on one of the ejection grooves 3 and another common drive electrode 13*a* formed on another one of the ejection grooves 3 are electrically connected to each other through the common terminal 16 which is placed on the front surface of the cover plate 8.

By forming the second through electrodes 21 near the ends of the ejection grooves 3, the electric resistance between the common terminal 16 and the common drive electrodes 13*a* is reduced. As a result, abnormality in ejecting liquid droplets caused by the wiring resistance can be reduced. Further, in the present embodiment, the second through electrodes 21 are formed near the opposite ends of the ejection grooves 3. However, the second through electrodes 21 may be formed on only one side of the ejection grooves 3, may be formed for every three ejection grooves 3, or may be further sparsely formed. Basically, the second through electrodes 21 can be arranged in a density that does not cause an ejection abnormality. Further, each of the individual terminals 17 has a T shape. A top part of the T shape is electrically connected to two first through electrodes 20, and a lower part of the T shape covers an ejection groove 3. In this manner, each of the individual terminals 17 functions as a terminal that is electrically connected to an external circuit.

Third Embodiment

Figure 5A:
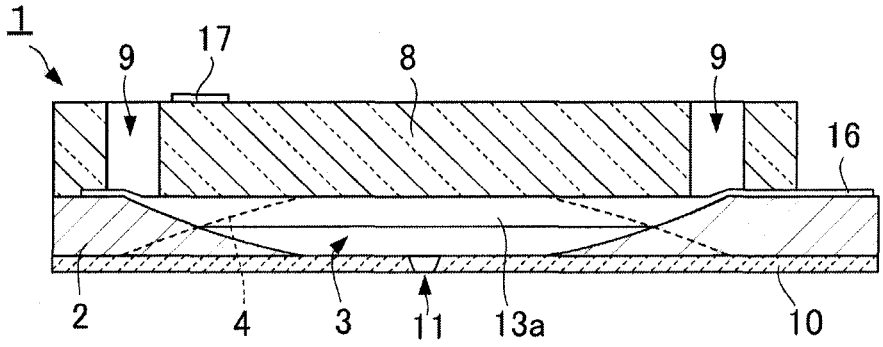
FIGS. 5A and 5B are schematic cross-sectional view of a liquid jet head according to a third embodiment of the present invention.
Figure 5B:
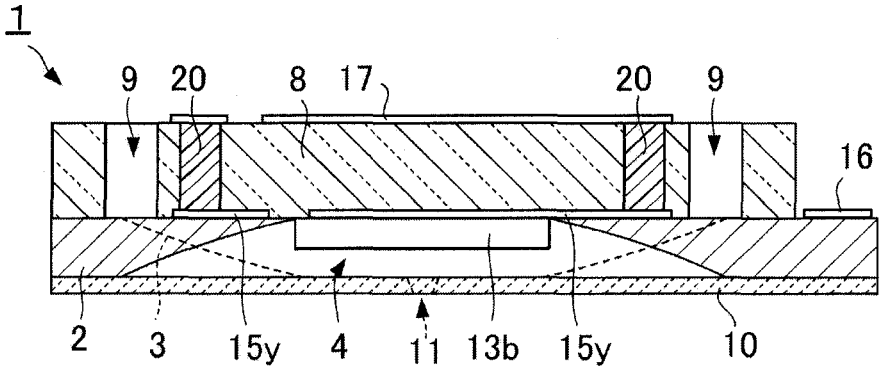

FIGS. 5A and 5B are schematic cross-sectional views of a liquid jet head 1 according to a third embodiment of the present invention. FIG. 5A is a schematic cross-sectional view of an ejection groove 3 in the groove direction. FIG. 5B is a schematic cross-sectional view of a non-ejection groove 4 in the groove direction. A different point from the first and second embodiments is that a common terminal 16 is placed on the surface of a piezoelectric body substrate 2. The other configurations are the same as those of the first and second embodiments. Therefore, hereinbelow, the different point will be mainly described, and description of the same configurations will be omitted. The same components or components having the same function are denoted by the same reference characters throughout the drawings.

As illustrated in FIG. 5A, the piezoelectric body substrate 2 has an exposed region to which a cover plate 8 is not bonded. The common terminal 16 which is electrically connected to common drive electrodes 13*a* is placed on the exposed region. The common terminal 16 is electrically connected to the common drive electrodes 13*a* of all ejection grooves 3. As illustrated in FIG. 5B, individual wiring units 15*y* which are electrically connected to drive electrodes 13*b* of non-ejection grooves 4, first through electrodes 20 which are electrically connected to the individual wiring units 15*y*, and individual terminals 17 which are electrically connected to the first through electrodes 20 are the same as those of the first embodiment or the second embodiment.

Accordingly, the number of through electrodes formed on the cover plate 8 is reduced, and the electrode structure is thereby simplified. The common terminal 16 is a single electrode terminal. Even when a plurality of groove rows 5 are formed on a single piezoelectric body substrate 2, common terminals 16 of the respective groove rows 5 can be communalized as a single electrode terminal. Instead of placing the common terminal 16 on the upper surface US of the piezoelectric body substrate 2, the common terminal 16 can be placed on the side surface of the piezoelectric body substrate 2, the side surface of the cover plate 8, or provided to extend to the front surface of the cover plate 8 through the side surface thereof.

Fourth Embodiment

Figure 6A:
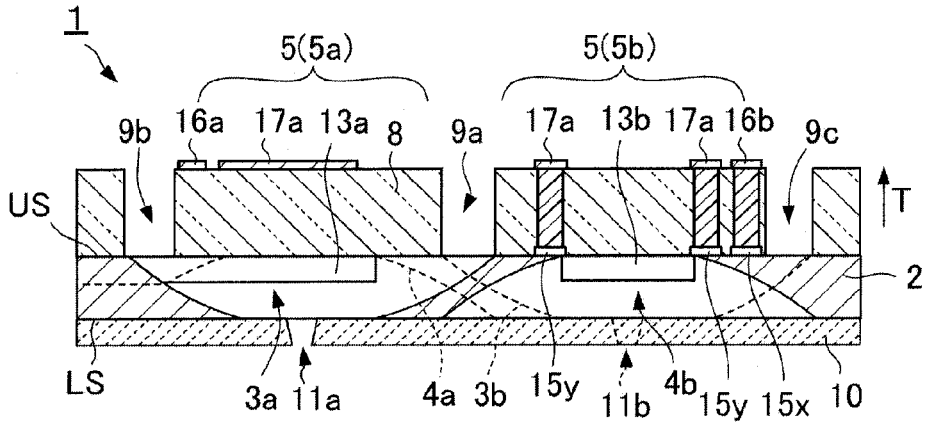
FIGS. 6A and 6B are explanatory drawings of a liquid jet head according to a fourth embodiment of the present invention.
Figure 6B:
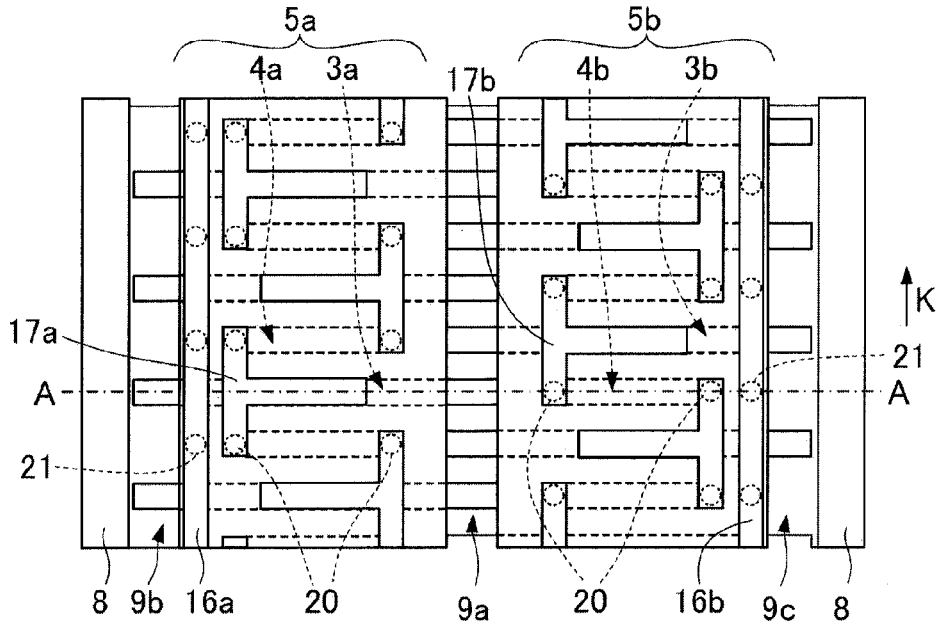

FIGS. 6A and 6B are explanatory drawings of a liquid jet head 1 according to a fourth embodiment of the present invention. FIG. 6A is a schematic cross-sectional view taken along line A-A illustrated in FIG. 6B. FIG. 6B is a schematic top view of the liquid jet head 1. In the liquid jet head 1 of the present embodiment, two groove rows 5 are formed on a single piezoelectric body substrate 2. Further, a first common terminal 16*a*, first individual terminals 17*a*, a second common terminal 16*b*, and second individual terminals 17*b* are placed on a single cover plate 8. The same components or components having the same function are denoted by the same reference characters throughout the drawings.

As illustrated in FIGS. 6A and 6B, the liquid jet head 1 is provided with the piezoelectric body substrate 2 on which first and second groove rows 5*a* and 5*b* are formed, the cover plate 8 which is bonded to an upper surface US of the piezoelectric body substrate 2, and a nozzle plate 10 which is bonded to a lower surface LS of the piezoelectric body substrate 2. The first groove row 5*a* and the second groove row 5*b* are arranged on the piezoelectric body substrate 2 in parallel to each other in a reference direction K. Further, in the adjacent two first and second groove rows 5*a* and 5*b*, ends on a second side (second ends) of first ejection grooves 3*a* included in the first groove row 5*a* located on a first side and ends on the first side (first ends) of second non-ejection grooves 4*b* included in the second groove row 5*b* located on the second side are separated from each other, and overlap each other in the thickness direction T of the piezoelectric body substrate 2. Similarly, ends on the first side (first ends) of second ejection grooves 3*b* included in the second groove row 5*b* located on the second side and ends on the second side (second ends) of first non-ejection grooves 4*a* included in the first groove row 5*a* located on the first side are separated from each other, and overlap each other in the thickness direction T of the piezoelectric body substrate 2.

Common drive electrodes 13*a* are formed on side surfaces of the first and second ejection grooves 3*a* and 3*b*. Individual drive electrodes 13*b* are formed on side surfaces of the first and second non-ejection grooves 4*a* and 4*b*. Each of the common drive electrodes 13*a* and the individual drive electrodes 13*b* is formed between a position corresponding to approximately ½ of the depth of each of the grooves, namely, the thickness of the piezoelectric body substrate 2 and the upper surface US. When a chevron type laminate piezoelectric body substrate is used, the common drive electrodes 13*a* and the individual drive electrodes 13*b* can be formed from the upper ends of the grooves up to a depth that is deeper than the polarization boundary. The individual drive electrodes 13*b* formed on the side surfaces of the first and second non-ejection grooves 4*a* and 4*b* are located within areas of opening portions in which the first and second non-ejection grooves 4*a* and 4*b* are open on the upper surface US in the groove direction. Further, the common drive electrodes 13*a* formed on the side surfaces of the first and second ejection grooves 3*a* and 3*b* extend up to the ends on the first side (first ends) of the first and second ejection grooves 3*a* and 3*b*. As the piezoelectric body substrate 2, PZT ceramics is used. The piezoelectric body substrate 2 is polarized in the normal direction of the upper surface US. The common drive electrodes 13*a* and the individual drive electrodes 13*b* may also be formed from the upper ends through the lower ends of the grooves. In this case, as the piezoelectric body substrate 2, a laminate piezoelectric body substrate obtained by laminating a piezoelectric body substrate which is polarized toward the upper side of the direction perpendicular to the surface of the substrate and a piezoelectric body substrate which is polarized toward the lower side of the direction perpendicular to the surface of the substrate can be used.

On the upper surface US of the piezoelectric body substrate 2, a common wiring unit 15*x* and individual wiring units 15*y* are provided in each of the first groove row 5*a* and the second groove row 5*b*. That is, the common wiring unit 15*x* of the first groove row 5*a* is electrically connected to the drive electrodes 13*a* of the first ejection grooves 3*a* included in the first groove row 5*a*. The individual wiring units 15*y* of the first groove row 5*a* are placed on both of the first side and the second side in the groove direction of the first non-ejection grooves 4*a* so as to be electrically separated from each other. Further, an individual wiring unit 15*y* on the first side in the groove direction is electrically connected to an individual drive electrode 13*b* formed on one side surface of a first non-ejection groove 4*a*, and an individual wiring unit 15*y* on the second side in the groove direction is electrically connected to an individual drive electrode 13*b* formed on the other side surface of the first non-ejection groove 4*a*. The common wiring unit 15*x* and the individual wiring units 15*y* of the second groove row 5*b* are placed in the same manner as in the first groove row 5*a*.

The cover plate 8 is provided with liquid chambers 9 which communicate with the first and second ejection grooves 3*a* and 3*b*, first and second common terminals 16*a* and 16*b* and first and second individual terminals 17*a* and 17*b* which are placed on a front surface thereof opposite to the piezoelectric body substrate 2, and first and second through electrodes 20 and 21 which penetrate the cover plate 8 from the front surface through aback surface facing the piezoelectric body substrate 2. The liquid chambers 9 include a common liquid chamber 9*a*, and two individual liquid chambers 9*b* and 9*c*. The common liquid chamber 9*a* communicates with the second ends of the first ejection grooves 3*a* included in the first groove row 5*a* located on the first side and the first ends of the second ejection grooves 3*b* included in the second groove row 5*b* located on the second side. Further, the individual liquid chamber 9*b* communicates with the first ends of the first ejection grooves 3*a* included in the first groove row 5*a* located on the first side. The individual liquid chamber 9*c* communicates with ends on the second side (second ends) of the second ejection grooves 3*b* included in the second groove row 5*b* located on the second side.

In the first groove row 5*a*, the first common terminal 16*a* is placed at a position substantially corresponding to the common wiring unit 15*x*. The second through electrodes 21 are placed between the first common terminal 16*a* and the common wiring unit 15*x* so as to correspond to the respective ejection grooves 3*a* to thereby electrically connect the first common terminal 16*a* and the common wiring unit 15*x* to each other. The first individual terminals 17*a* are placed corresponding to the respective first ejection grooves 3*a*, and have a T shape. Each of the first individual terminals 17*a* is electrically connected to two individual wiring units 15*y* between which a first ejection groove 3*a* is interposed through two first through electrodes 20 on a top part of the T shape. A lower part of the T shape is located above the first ejection groove 3*a*, and functions as a terminal that is electrically connected to wiring of a flexible circuit board (not illustrated). That is, two individual drive electrodes 13*b* that are formed on side surfaces of two adjacent non-ejection grooves 4 between which an ejection groove 3 is interposed, the side surfaces facing the ejection groove 3, are electrically connected to each other through an individual terminal 17 placed on the front surface of the cover plate 8. The same numbers of first individual terminals 17*a* as the first ejection grooves 3*a* are arranged along the first groove row 5*a* with the top parts of the T shapes alternately facing right and left. In the second groove row 5*b*, the second common terminal 16*b* and the second individual terminals 17*b* are arranged in the same manner as the first common terminal 16*a* and the first individual terminals 17*a*.

The nozzle plate 10 is provided with first nozzles 11*a* and second nozzles 11*b*, and bonded to the lower surface LS of the piezoelectric body substrate 2. The first nozzles 11*a* communicate with the respective first ejection grooves 3*a*, and the second nozzles 11*b* communicate with the respective second ejection grooves 3*b*.

In this manner, the first and second individual terminals 17*a* and 17*b* and the first and second common terminals 16*a* and 16*b* are formed on the front surface of the cover plate 8, and a drive signal for driving the first ejection grooves 3*a* of the first groove row 5*a* and the second ejection grooves 3*b* of the second groove row 5*b* is supplied from the front surface of the cover plate 8. Therefore, the size of the piezoelectric body substrate 2, in particular, the width in the groove direction thereof can be made compact.

Further, the first and second non-ejection grooves 4*a* and 4*b* are not open in an overlapping area in which the first ejection grooves 3*a* and the second ejection grooves 3*b* overlap each other in the reference direction K. Therefore, it is not necessary to provide slits in the common liquid chamber 9*a* for allowing the common liquid chamber 9*a* and the first and second ejection grooves 3*a* and 3*b* to communicate with each other and blocking the first and second non-ejection grooves 4*a* and 4*b* with respect to the common liquid chamber 9*a*. The first ejection grooves 3*a* and the second non-ejection grooves 4*b* which overlap each other in the thickness direction T are separated from each other. Further, the second ejection grooves 3*b* and the first non-ejection grooves 4*a* which overlap each other in the thickness direction T are separated from each other. Therefore, liquid flowing into the common liquid chamber 9*a* flows through the first ejection grooves 3*a* and then flows out to the individual liquid chamber 9*b*, and flows through the second ejection grooves 3*b* and then flows out to the individual liquid chamber 9*c*, without flowing into the first and second non-ejection grooves 4*a* and 4*b*. Further, a part of the liquid flowing into the first and second ejection grooves 3*a* and 3*b* is ejected from the nozzles 11*a* communicating with the respective first ejection grooves 3*a* and the nozzles 11*b* communicating with the respective second ejection grooves 3*b*.

Further, the second ends facing the second groove row 5*b* of the first ejection grooves 3*a* and the first ends facing the first groove row 5*a* of the second ejection grooves 3*b* are preferably positioned within an area of an opening portion of the liquid chamber 9*a*, the opening portion facing the piezoelectric body substrate 2. Similarly, the first ends opposite to the second groove row 5*b* of the first ejection grooves 3*a* are preferably positioned within an area of an opening portion of the individual liquid chamber 9*b*, the opening portion facing the piezoelectric body substrate 2. Further, the second ends opposite to the first groove row 5*a* of the second ejection grooves 3*b* are preferably positioned within an area of an opening portion of the individual liquid chamber 9*c*, the opening portion facing the piezoelectric body substrate 2. Accordingly, liquid pools in internal areas of the first and second ejection grooves 3*a* and 3*b* and flow paths of the common liquid chamber 9*a* and the individual liquid chambers 9*b* and 9*c* are reduced, which makes it possible to reduce accumulation of air bubbles.

The liquid jet head 1 is driven in the following manner. Liquid supplied to the common liquid chamber 9*a* flows into the first and second ejection grooves 3*a* and 3*b* to be filled in the first and second ejection grooves 3*a* and 3*b*. Further, the liquid flows from the first ejection grooves 3*a* into the individual liquid chamber 9*b* and from the second ejection grooves 3*b* into the individual liquid chamber 9*c* to be circulated. For example, when liquid droplets are ejected from the nozzles 11*a* which communicate with the respective first ejection grooves 3*a*, a drive signal is applied to the common drive electrodes 13 and the individual drive electrodes 13*b* on the side walls of the first ejection grooves 3*a* to cause the side walls to thickness-shear deform to thereby change the capacity of the first ejection grooves 3*a*. Accordingly, liquid droplets are ejected from the first nozzles 11*a* communicating with the respective first ejection grooves 3*a*. More specifically, the drive signal is applied between the first common terminal 16*a* and the first individual terminals 17*a* to cause the side walls of the first ejection grooves 3*a* to thickness-shear deform. Practically, the first common terminal 16*a* is fixed to a GND level potential, and the drive signal is applied to the first individual terminals 17*a*. The second ejection grooves 3*b* are driven in the same manner. Liquid may be circulated so as to flow from the individual liquid chambers 9*b* and 9*c* and flow out to the common liquid chamber 9*a*, or may also be supplied to the first and second ejection grooves 3*a* and 3*b* from all of the common liquid chamber 9*a* and the individual liquid chambers 9*b* and 9*c*.

Liquid is not filled in the first and second non-ejection grooves 4*a* and 4*b*. Further, the individual wiring units 15*y* between the first and second individual terminals 17*a* and 17*b* and the individual drive electrodes 13*b* of the first and second non-ejection grooves 4*a* and 4*b* do not have contact with liquid. Therefore, even when conductive liquid is used, a drive signal applied between the first individual terminals 17*a* and the first common terminal 16*a* or between the second individual terminals 17*b* and the second common terminal 16*b* does not leak through the liquid. Further, a trouble caused by the electrolysis of the common drive electrodes 13*a* or the like does not occur.

The distance between the first groove row 5*a* and the second groove row 5*b* can be reduced to thereby arrange the first and second ejection grooves 3*a* and 3*b* in high density. Further, the width in the groove direction of the piezoelectric body substrate 2 can be reduced. Therefore, it is possible to increase the number of piezoelectric body substrates 2 obtained from a single piezoelectric body wafer to thereby achieve cost reduction. Further, the second ends of the first ejection grooves 3*a* and the first ends of the second ejection grooves 3*b* overlap each other in the reference direction K, and the first non-ejection grooves 4*a* and the second non-ejection grooves 4*b* are not open in this overlapping area. Further, the first and second non-ejection grooves 4*a* and 4*b* are not open also in an area of the first ends of the first ejection grooves 3*a* and an area of the second ends of the second ejection grooves 3*b*. Therefore, it is not necessary to provide slits for blocking the first non-ejection grooves 4*a* and the second non-ejection grooves 4*b*. As a result, the structure of the cover plate 8 can be simplified.

Although the two groove rows are formed in the present embodiment, three or more groove rows can be formed. Even when the number of groove rows is increased, since the common terminals 16 and the individual terminals 17 are placed on the front surface of the cover plate 8, the electrical connection with an external circuit, can be made easy.

Fifth Embodiment

Figure 7:
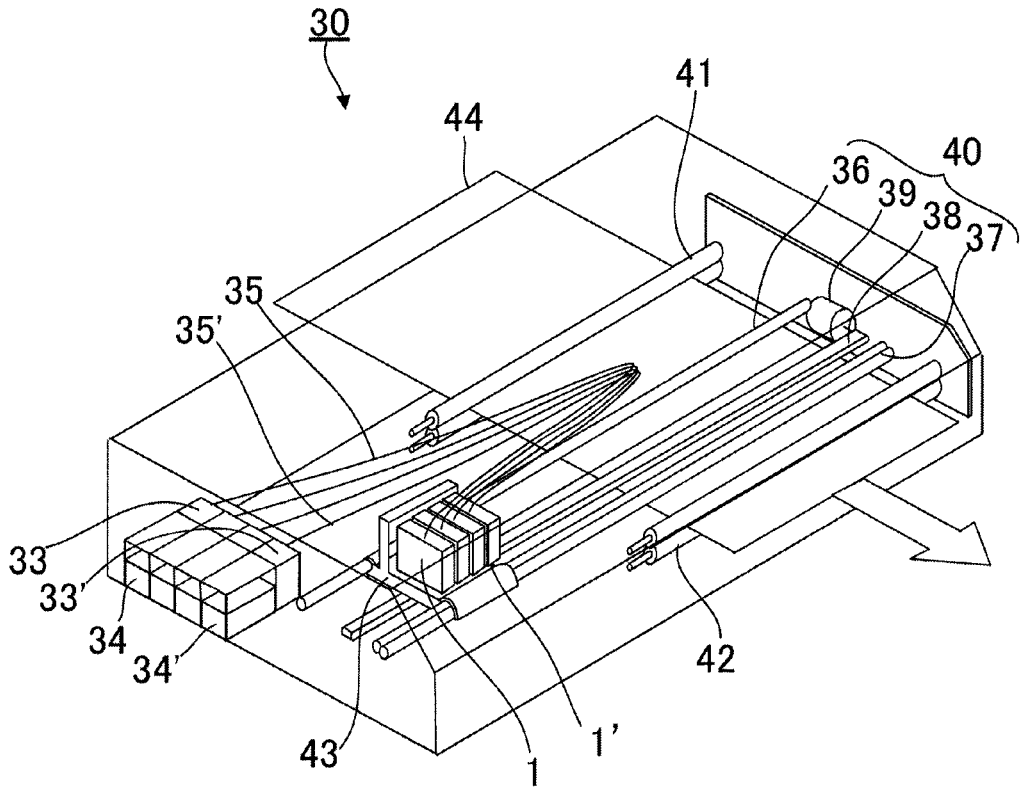
FIG. 7 is a schematic perspective view of a liquid jet apparatus according to a fifth embodiment of the present invention.
Figure 8A:
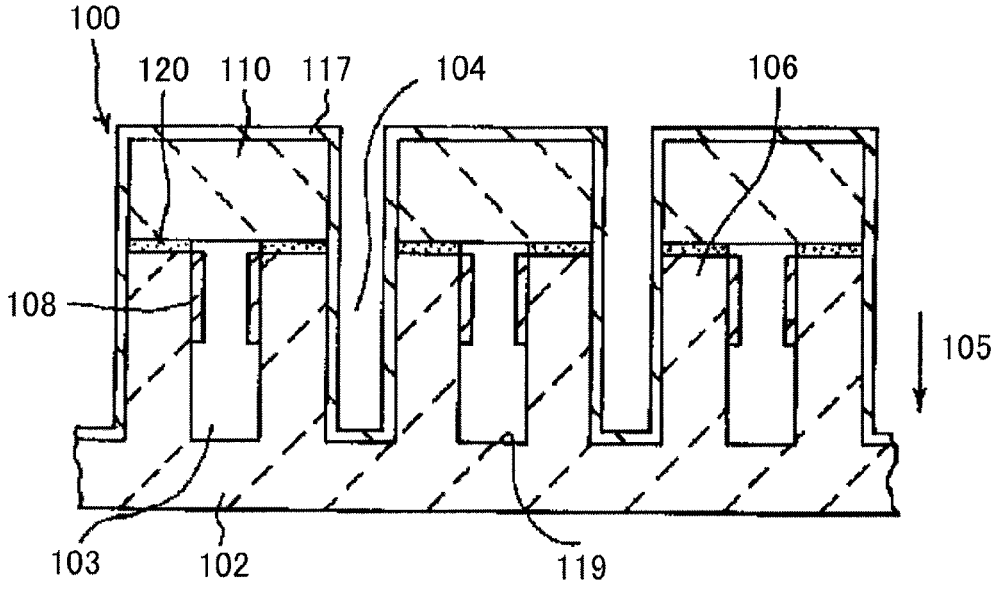
Fig.8A Prior art
FIGS. 8A and 8B are cross-sectional schematic views of a conventionally-known liquid jet head.
Figure 8B:
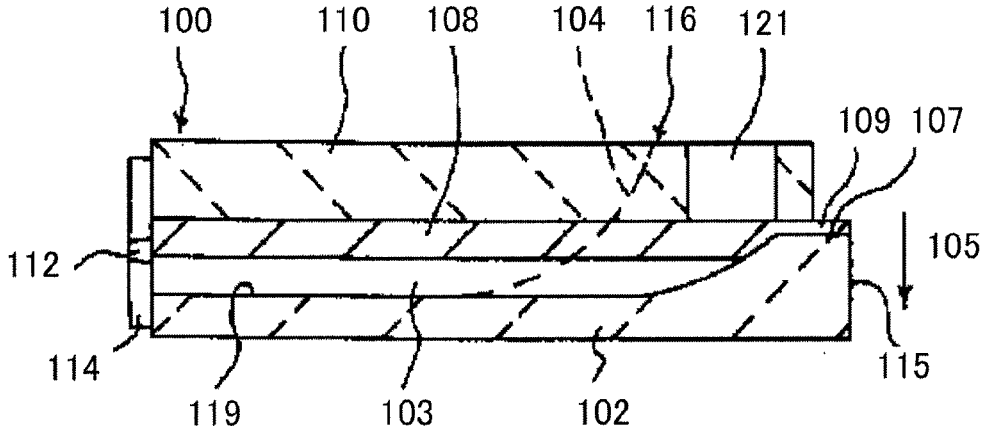
Fig.8B Prior art

FIG. 7 is a schematic perspective view of a liquid jet apparatus 30 according to the fifth embodiment of the present invention. The liquid jet apparatus 30 is provided with a movement mechanism 40 which reciprocates liquid jet heads 1 and 1', flow path sections 35 and 35' which respectively supply liquid to the liquid jet heads 1 and 1' and discharge liquid from the liquid jet heads 1 and 1', and liquid pumps 33 and 33' and liquid tanks 34 and 34' which respectively communicate with the flow path sections 35 and 35'. Each of the liquid jet heads 1 and 1' is provided with a plurality of groove rows. Further, ends on the second side of ejection grooves included in a groove row located on the first side and ends on the first side of non-ejection grooves included in a groove row located on the second side are separated from each other, and overlap each other in the thickness direction of a piezoelectric body substrate. As each of the liquid jet heads 1 and 1', any one of the liquid jet heads of the first to fourth embodiments is used.

The liquid jet apparatus 30 is provided with a pair of conveyance units 41 and 42 which conveys a recording medium 44 such as paper in a main scanning direction, the liquid jet heads 1 and 1' each of which ejects liquid onto the recording medium 44, a carriage unit 43 on which the liquid jet heads 1 and 1' are loaded, the liquid pumps 33 and 33' which respectively supply liquid stored in the liquid tanks 34 and 34' to the flow path sections 35 and 35' by pressing, and the movement mechanism 40 which moves the liquid jet heads 1 and 1' in a sub-scanning direction that is perpendicular to the main scanning direction. A control unit (not illustrated) controls the liquid jet heads 1 and 1', the movement mechanism 40, and the conveyance units 41 and 42 to drive.

Each of the pair of conveyance units 41 and 42 extends in the sub-scanning direction, and includes a grid roller and a pinch roller which rotate with the roller surfaces thereof making contact with each other. The grid roller and the pinch roller are rotated around the respective shafts by a motor (not illustrated) to thereby convey the recording medium 44, which is sandwiched between the rollers, in the main scanning direction. The movement mechanism 40 is provided with a pair of guide rails 36 and 37 each of which extends in the sub-scanning direction, the carriage unit 43 which can slide along the pair of guide rails 36 and 37, an endless belt 38 to which the carriage unit 43 is coupled to move the coupled carriage unit 43 in the sub-scanning direction, and a motor 39 which allows the endless belt 38 to circulate via pulleys (not illustrated).

The carriage unit 43 loads the plurality of liquid jet heads 1 and 1' thereon. The liquid jet heads 1 and 1' eject, for example, liquid droplets of four colors including yellow, magenta, cyan, and black. Each of the liquid tanks 34 and 34' stores liquid of corresponding color, and supplies the stored liquid to each of the liquid jet heads 1 and 1' through each of the liquid pumps 33 and 33' and each of the flow path sections 35 and 35'. Each of the liquid jet heads 1 and 1' ejects liquid droplets of corresponding color in response to a driving signal. Any patterns can be recorded on the recording medium 44 by controlling the timing of ejecting liquid from the liquid jet heads 1 and 1', the rotation of the motor 39 for driving the carriage unit 43, and the conveyance speed of the recording medium 44.

In the liquid jet apparatus 30 of the present embodiment, the movement mechanism 40 moves the carriage unit 43 and the recording medium 44 to perform recording. Alternatively, however, the liquid jet apparatus may have a configuration in which a carriage unit is fixed, and a movement mechanism two-dimensionally moves a recording medium to perform recording. That is, the movement mechanism may have any configuration as long as it can relatively move a liquid jet head and a recording medium.

What is claimed is:

1. A liquid jet head comprising:

a piezoelectric body substrate, the piezoelectric body substrate including at least one groove row in which ejection grooves penetrating the piezoelectric body substrate from an upper surface thereof through a lower surface thereof and non-ejection grooves open on the upper surface are alternately arranged in a reference direction, common drive electrodes formed on both side surfaces of each of the ejection grooves, and individual drive electrodes formed on both side surfaces of each of the non-ejection grooves; and a cover plate bonded to the upper surface of the piezoelectric body substrate, the cover plate including a liquid chamber communicating with the ejection grooves, first through electrodes penetrating the cover plate in a thickness direction, the first through electrodes being electrically connected to the individual drive electrodes, and individual terminals placed on a front surface of the cover plate opposite to the piezoelectric body substrate, the individual terminals being electrically connected to the first through electrodes, wherein the piezoelectric body substrate includes a common wiring unit electrically connected to the common drive electrodes and individual wiring units electrically connected to the individual drive electrodes, the common wiring unit and the individual wiring units being placed on the upper surface of the piezoelectric body substrate, and wherein the individual drive electrodes and the first through electrodes are electrically connected to each other through the individual wiring units.

2. The liquid jet head according to claim 1, wherein the individual wiring units are placed on opposite ends in the longitudinal direction of opening portions in which the non-ejection grooves are open so as to be electrically separated from each other, and the individual wiring unit located on one end is electrically connected to an individual drive electrode formed on one side surface of a non-ejection groove and the individual wiring unit located on the other end is electrically connected to an individual drive electrode formed on the other side surface of the non-ejection groove.

3. The liquid jet head according to claim 1, wherein the cover plate includes first intermediate electrodes which are electrically connected to the first through electrodes and placed on a back surface of the cover plate facing the piezoelectric body substrate, and the individual wiring units and the first through electrodes are electrically connected to each other through the first intermediate electrodes.

4. The liquid jet head according to claim 1, wherein the cover plate includes a second through electrode which penetrates the cover plate in the thickness direction thereof and is electrically connected to the common wiring unit, and a common terminal which is electrically connected to the second through electrode and placed on the front surface opposite to the piezoelectric body substrate.

5. The liquid jet head according to claim 4, wherein the cover plate includes a second intermediate electrode which is electrically connected to the second through electrode and placed on the back surface facing the piezoelectric body substrate, and the common wiring unit and the second through electrode are electrically connected to each other through the second intermediate electrode.

6. The liquid jet head according to claim 4, wherein a common drive electrode formed on one of the ejection grooves and another common drive electrode formed on another one of the ejection grooves are electrically connected to each other through the common terminal.

7. The liquid jet head according to claim 4, wherein a common drive electrode formed on one of the ejection grooves and another common drive electrode formed on another one of the ejection grooves are electrically connected to each other through the common wiring unit.

8. The liquid jet head according to claim 1, wherein two individual drive electrodes formed on side surfaces of two adjacent non-ejection grooves between which an ejection groove is interposed, the side surfaces facing the ejection groove, are electrically connected to each other through the corresponding one of the individual terminals.

9. The liquid jet head according to claim 8, wherein each of the individual terminals is placed on the cover plate across the corresponding one of the ejection grooves in a plan view viewed from the normal direction of the piezoelectric body substrate.

10. The liquid jet head according to claim 1, further comprising a flexible circuit board including wiring, wherein the flexible circuit board is electrically connected to the front surface of the cover plate by the wiring being electrically connected to the individual terminals.

11. The liquid jet head according to claim 1, wherein the at least one groove row comprises a plurality of groove rows arranged in parallel to each other in the reference direction.

12. The liquid jet head according to claim 11, wherein, in adjacent ones of the groove rows, ends on a second side of ejection grooves included in a groove row located on a first side and ends on the first side of non-ejection grooves included in a groove row located on the second side are separated from each other, and overlap each other in a thickness direction of the piezoelectric body substrate.

13. A liquid jet apparatus comprising:

the liquid jet head according to claim 1;

a movement mechanism configured to relatively move the liquid jet head and a recording medium;

a liquid supply tube configured to supply liquid to the liquid jet head; and a liquid tank configured to supply the liquid to the liquid supply tube.

* * * * *